US010255801B2

(12) United States Patent
Alameh et al.

(10) Patent No.: US 10,255,801 B2
(45) **Date of Patent: *Apr. 9, 2019**

(54) PORTABLE ELECTRONIC DEVICE WITH DUAL, DIAGONAL PROXIMITY SENSORS AND MODE SWITCHING FUNCTIONALITY

(71) Applicant: Motorola Mobility LLC, Chicago, IL (US)

(72) Inventors: Rachid M Alameh, Crystal Lake, IL (US); Patrick J Cauwels, South Beloit, IL (US); Paul Steuer, Hawthorn Woods, IL (US)

(73) Assignee: Motorola Mobility LLC, Chicago, IL (US)

( * ) Notice: Subject to any disclaimer, the term of this patent is extended or adjusted under 35 U.S.C. 154(b) by 622 days.

This patent is subject to a terminal disclaimer.

(21) Appl. No.: 14/595,258

(22) Filed: Jan. 13, 2015

(65) Prior Publication Data

US 2016/0203709 A1 Jul. 14, 2016

(51) Int. Cl.
*G08C 19/16* (2006.01)
*G08C 23/04* (2006.01)

(52) U.S. Cl.
CPC ..... *G08C 19/16* (2013.01); *G08C 23/04* (2013.01)

(58) Field of Classification Search
CPC .... G06F 1/3203; G06F 1/3206; G06F 1/3231; G08C 19/16; G08C 23/04
See application file for complete search history.

(56) References Cited

U.S. PATENT DOCUMENTS 7,016,705 B2 * 3/2006 Bahl ..... G06F 1/3203 455/566
7,714,265 B2 * 5/2010 Fadell ..... G01J 1/4204 250/201.1

(Continued)

FOREIGN PATENT DOCUMENTS

CN 1841249 10/2006
CN 102440063 5/2012

(Continued)

OTHER PUBLICATIONS

Rachid M. Alameh, et al., "Portable Electronic Device with Dual, Diagonal Proximity Sensors and Mode Switching Functionality"; U.S. Appl. No. 14/595,257, filed Jan. 13, 2015, 40 pages.

(Continued)

*Primary Examiner* — Ryan W Sherwin
(74) *Attorney, Agent, or Firm* — Philip H. Burrus, IV

(57) ABSTRACT

An electronic device includes a housing and one or more processors. At least one proximity sensor component is operable with the one or more processors and can include an infrared signal receiver to receive an infrared emission from an object external to the housing. The one or more processors can operate the at least one proximity sensor component at a first sensitivity until the infrared signal receiver receives the infrared emission from the object, and then operate the at least one proximity sensor component at a second sensitivity after the infrared signal receiver receives the infrared emission from the object. A motion detector can be actuated when the infrared signal receiver receives the infrared emission from the object at the first distance.

16 Claims, 9 Drawing Sheets

(56) References Cited

U.S. PATENT DOCUMENTS

| | | | | |
|---|---|---|---|---|
| 8,433,445 | B2 * | 4/2013 | Busse | G01S 17/026 340/5.72 |
| 2002/0135474 | A1 * | 9/2002 | Sylliassen | G06F 1/3203 340/540 |
| 2010/0164479 | A1 | 7/2010 | Alameh et al. | |
| 2012/0050189 | A1 * | 3/2012 | Choboter | H04M 1/72577 345/173 |
| 2014/0075230 | A1 * | 3/2014 | Suggs | H02J 7/35 713/323 |

FOREIGN PATENT DOCUMENTS

| | | |
|---|---|---|
| CN | 103339578 | 10/2013 |
| CN | 103562818 | 2/2014 |
| WO | 2010/077550 | 7/2010 |
| WO | 2012/053941 | 4/2012 |
| WO | 2012/166109 | 12/2012 |

OTHER PUBLICATIONS

Rachid M. Alameh, et al., "Portable Electronic Device with Dual, Diagonal Proximity Sensors and Mode Switching Functionality"; U.S. Appl. No. 14/595,261, filed Jan. 13, 2015, 35 pages.

Rachid M. Alameh, et al., "Adaptive Filtering for Presence Detection"; U.S. Appl. No. 14/620,257, filed Feb. 12, 2015, 27 pages.

Rachid M. Alameh, et al., "Portable Electronic Device with Proximity Sensors for Gesture Control and Contact Detection"; U.S. Appl. No. 14/619,263, filed Feb. 11, 2015, 44 pages.

"Exam Report", Chinese Application No. 201610021064.9; dated Jan. 29, 2018.

"Second Exam Report", Chinese Application No. 201610021064.9; dated Jul. 13, 2018.

Ballard, Tristan , "Search and Exam Report", Great Britain Application No. GB1600452.5; dated Jun. 28, 2016.

* cited by examiner

PORTABLE ELECTRONIC DEVICE WITH DUAL, DIAGONAL PROXIMITY SENSORS AND MODE SWITCHING FUNCTIONALITY

BACKGROUND

Technical Field

This disclosure relates generally to electronic devices, and more particularly to portable electronic devices having proximity sensors.

Background Art

Proximity sensors detect the presence of nearby objects before those objects contact the device in which the proximity sensors are disposed. Illustrating by example, some proximity sensors emit an electromagnetic or electrostatic field. A receiver then receives reflections of the field from the nearby object. The proximity sensor detects changes in the received field to detect positional changes of nearby objects based upon changes to the electromagnetic or electrostatic field resulting from the object becoming proximately located with a sensor. Electronic devices employ such proximity sensors to manage audio and video device output.

For example, when a device determines that a user's face is proximately located with the device, the device may reduce speaker volume so as not to over stimulate the user's eardrums. As another example, the proximity sensor may turn off the device display when the device is positioned near the user's ear to save power. Thus, these types of wireless communication device dynamically adjust the operation of audio and video output components when these components are positioned very close to, i.e., adjacent to, a user's ear. To work properly, the transmitter emitting the electromagnetic or electrostatic field in these proximity sensors draws power and must be continually operational, which can lead to reduced run time. It would be advantageous to have an improved proximity sensor systems and new uses for the same.

Figure 1:
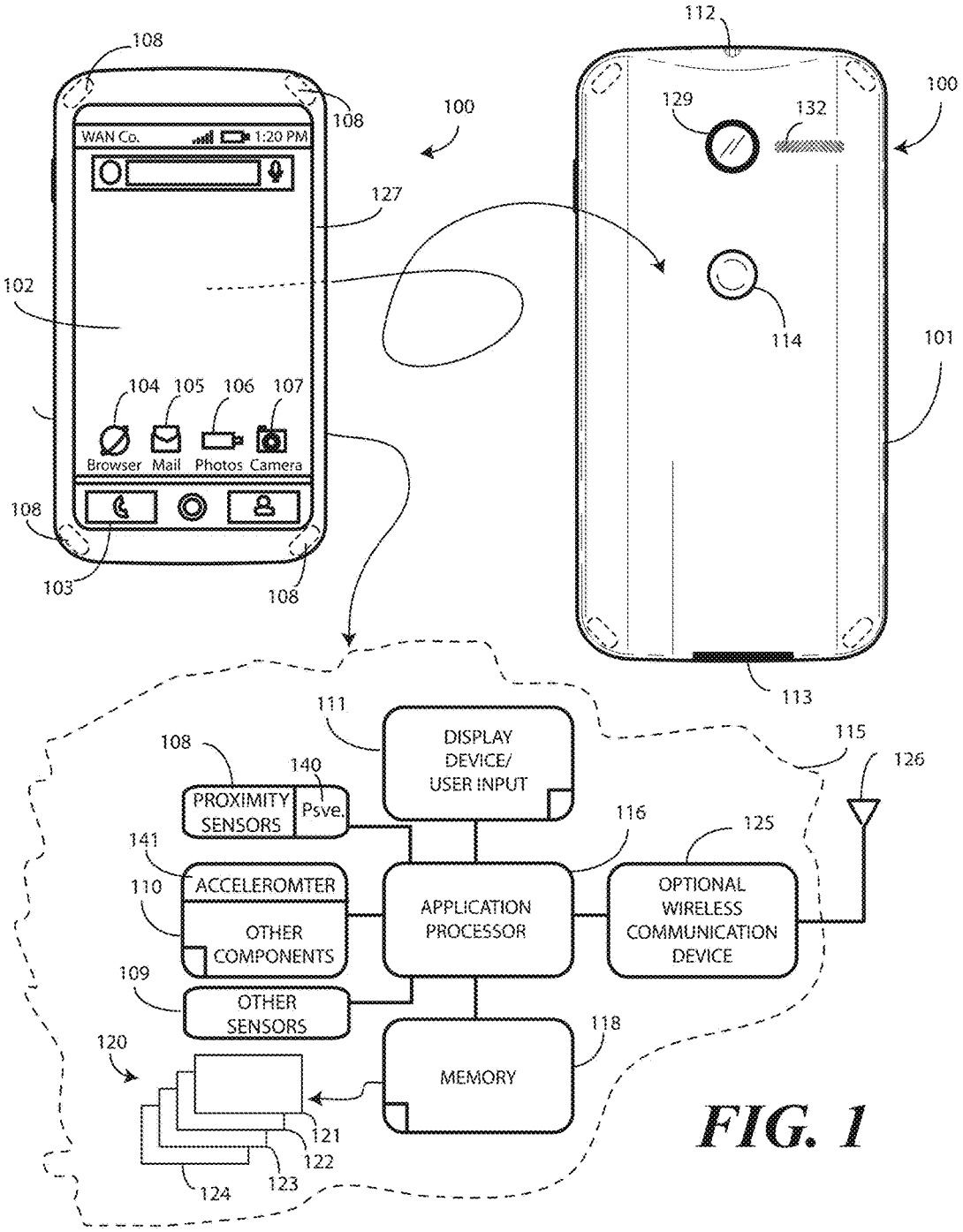
FIG. 1 illustrates one explanatory portable electronic device in accordance with one or more embodiments of the disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION OF THE DRAWINGS

Before describing in detail embodiments that are in accordance with the present disclosure, it should be observed that the embodiments reside primarily in combinations of method steps and apparatus components related to using proximity sensor components to control modes of operation of an electronic device. Any process descriptions or blocks in flow charts should be understood as representing modules, segments, or portions of code that include one or more executable instructions for implementing specific logical functions or steps in the process.

Embodiments of the disclosure do not recite the implementation of any commonplace business method aimed at processing business information, nor do they apply a known business process to the particular technological environment of the Internet. Moreover, embodiments of the disclosure do not create or alter contractual relations using generic computer functions and conventional network operations. Quite to the contrary, embodiments of the disclosure employ methods that, when applied to electronic device and/or user interface technology, improve the functioning of the electronic device itself by reducing power consumption, extending run time, and improving the overall user experience to overcome problems specifically arising in the realm of the technology associated with electronic device user interaction.

Alternate implementations are included, and it will be clear that functions may be executed out of order from that shown or discussed, including substantially concurrently or in reverse order, depending on the functionality involved. Accordingly, the apparatus components and method steps have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

It will be appreciated that embodiments of the disclosure described herein may be comprised of one or more conventional processors and unique stored program instructions that control the one or more processors to implement, in conjunction with certain non-processor circuits, some, most, or all of the functions of controlling proximity sensors to control device operation as described herein. The non-processor circuits may include, but are not limited to, a radio receiver, a radio transmitter, signal drivers, clock circuits, power source circuits, and user input devices. As such, these functions may be interpreted as steps of a method to perform device control in response to one or more proximity sensors components. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used. Thus, methods and means for these functions have been described herein. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ASICs with minimal experimentation.

Embodiments of the disclosure are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. Also, reference designators shown herein in parenthesis indicate components shown in a figure other than the one in discussion. For example, talking about a device (10) while discussing figure A would refer to an element, 10, shown in figure other than figure A.

Embodiments of the disclosure provide an electronic device, which may be portable in one or more embodiments, having a housing. The housing can include a front major face, a rear major face, a first side edge, and a second side edge. In one embodiment, a display or other user interface component is disposed along the front major face. One or more processors can be operable with the display or user interface.

In one embodiment, the electronic device has at least one proximity sensor component that is operable with the one or more processors. In one embodiment, the at least one proximity sensor component comprises a receiver only, and does not include a corresponding transmitter. As used herein, a proximity sensor component comprises a signal receiver only that does not include a corresponding transmitter to emit signals for reflection off an object to the signal receiver.

Illustrating by example, in one the proximity sensor component comprises a signal receiver to receive signals from objects external to the housing of the electronic device. In one embodiment, the signal receiver is an infrared signal receiver to receive an infrared emission from an object such as a human being when the human is proximately located with the electronic device. In one or more embodiments, the proximity sensor component is configured to receive infrared wavelengths of about four to about ten micrometers. This wavelength range is advantageous in one or more embodiments in that it corresponds to the wavelength of heat emitted by the body of a human being. Additionally, detection of wavelengths in this range is possible from farther distances than, for example, would be the detection of reflected signals from the transmitter of a proximity detector component.

Accordingly, the one or more processors and other components of the electronic device may be in a low power or sleep mode when no user is near the electronic device. During this time, the at least one proximity sensor component, which consumes very little power in one or more embodiments, can be active. In some embodiments, the at least one proximity sensor component is active all the time.

When a user comes within reception thermal detection range of the at least one proximity sensor component, infrared emissions from the user are detected by the signal receiver of the at least one proximity sensor component. Upon this detection, one or more processors can be notified of the detection and can then actuate one or more user interface devices in response to the infrared signal receiver receiving the infrared emission from the user. Accordingly, one or more user interface components of the electronic device will be ready to use once the user reaches the device without requiring additional user operations to bring the device out of the low power or sleep mode.

A simple use case is helpful in demonstrating how one or more embodiments of the disclosure can be used. When a user is away from an electronic device and not within a detection range, components other than the proximity sensor component and its associated detection circuitry can be placed in a low power or sleep mode to conserve power. Said differently, everything in the device other than the proximity sensor components can be placed into a low power, OFF state, or sleep mode. In one or more embodiments, the proximity sensor component and its associated circuitry is the only sensor device that remains active to monitor a 360-degree coverage area across a variable range that can be set to receive infrared emissions from a distance of only few inches from the device to about ten feet. In one embodiment, the proximity sensor component only consumes on the order of five microamps in this mode.

While the user is away, the one or more processors of the device may operate the at least one proximity sensor component at a first sensitivity. The first sensitivity can be set by adjusting a gain associated with the at least one proximity sensor component. Alternatively, the first sensitivity can be set by adjusting a detection threshold of the at least one proximity sensor component. Other methods of establishing a first sensitivity, which defines from what distance infrared emissions can be detected, will be obvious to those of ordinary skill in the art having the benefit of this disclosure. In one embodiment the first sensitivity is set so that infrared emissions from a user disposed between six and ten feet from the device will be received.

When a person comes within the detection radius of the device defined by the first sensitivity, the at least one proximity sensor component receives an infrared emission from the person's body heat. When this occurs, the at least one proximity sensor component can cause one of several actions to occur. In one embodiment, the at least one proximity sensor component can include a self-trigger and/or interrupt and can change its operating mode, which may include changing its duty cycle. In one embodiment, the at least one proximity sensor component can further, through its associated processing circuitry, actuate a motion detector in anticipation of next actions the user may take, such picking up the device following presence detection. Once motion is detected, the range and/or sensitivity of the at least one proximity sensor component can be adjusted. This adjustment can be in response to detection of motion of the electronic device in one or more embodiments. Optionally, the at least one proximity sensor component can wake the one or more processors, which can then actuate one or more user interface devices.

The proximity sensor component itself, or alternatively the one or more processors, may also alter the sensitivity of the at least one proximity sensor component. The person's presence could be a user approaching to use the device.

Alternatively, it may just be a passer by who has no interest in using the device. To further conserve power, and to further ready the device for use, in one embodiment the one or more processors may transition the at least one proximity sensor component to operate at a second sensitivity or sensitivity level after the signal receiver receives the infrared emissions.

In one embodiment, the second sensitivity is less than the first sensitivity, which requires the person to be closer to the electronic device for infrared emissions in the form of body heat to be detected by the signal receiver of the at least one proximity sensor component. For example, while the first sensitivity may have received user infrared emissions from a distance of between six and ten feet, the second sensitivity may receive infrared emissions from a distance of between one half inch and six inches. These numbers are illustrative only, as other ranges will be obvious to those of ordinary skill in the art having the benefit of this disclosure. The second sensitivity can be set by adjusting the gain of the signal receiver in one embodiment. In other embodiments the second sensitivity can be set by adjusting a detection threshold of the sensitivity receiver. In an alternate embodiment, threshold or gain is not changed but rather software interpretation of detected heat levels is adjusted. For instance, as user gets close, thermal detection may deliver large readings, but the processor or control device may only respond to strong levels indicating very close proximity.

If the user picks up the device, motion will be detected by the motion detector, which in one embodiment is an accelerometer or a gyroscope. This detected motion can be used to bring the device out of the low power or sleep mode. As the at least one proximity sensor component is being operated at the second sensitivity, in one or more embodiments infrared emissions from the user's hands or fingers can be detected by the signal receiver of the at least one proximity sensor component and can be interpreted by the one or more processors as user input. Accordingly, the user can control device functionality by delivering infrared emissions to the at least one proximity sensor component. By contrast, if the device is not moved within a predefined time, this can be interpreted as the detected user not being interested in using the electronic device. Accordingly, the device can be returned to the default state with the at least one proximity sensor component In one embodiment, where motion is detected by the motion detector after the motion detector is enabled by the at least one proximity sensor detecting infrared emissions when operating at the first sensitivity, the one or more processors can actuate the display or additional user interface component such as a microphone. In one embodiment, the one or more processors may initially keep the display OFF, turning it on only after the motion detector detects motion of the device to conserve power. These use cases are merely examples illustrating how embodiments of the disclosure can be used. Others will be readily obvious to those of ordinary skill in the art having the benefit of this disclosure.

Turning now to FIG. 1, illustrated therein is one explanatory electronic device 100 configured in accordance with one or more embodiments of the disclosure. The electronic device 100 of FIG. 1 is a portable electronic device, and is shown as a smart phone for illustrative purposes. However, it should be obvious to those of ordinary skill in the art having the benefit of this disclosure that other electronic devices may be substituted for the explanatory smart phone of FIG. 1. For example, the electronic device 100 could equally be a conventional desktop computer, palm-top computer, a tablet computer, a gaming device, a media player, or other device.

This illustrative electronic device 100 includes a display 102, which may optionally be touch-sensitive. In one embodiment where the display 102 is touch-sensitive, the display 102 can serve as a primary user interface 111 of the electronic device 100. Users can deliver user input to the display 102 of such an embodiment by delivering touch input from a finger, stylus, or other objects disposed proximately with the display. In one embodiment, the display 102 is configured as an active matrix organic light emitting diode (AMOLED) display. However, it should be noted that other types of displays, including liquid crystal displays, would be obvious to those of ordinary skill in the art having the benefit of this disclosure.

The explanatory electronic device 100 of FIG. 1 includes a housing 101. In one embodiment, the housing 101 includes two housing members. A front housing member 127 is disposed about the periphery of the display 102 in one embodiment. A rear-housing member 128 forms the backside of the electronic device 100 in this illustrative embodiment and defines a rear major face of the electronic device. Features can be incorporated into the housing members 127,128. Examples of such features include an optional camera 129 or an optional speaker port 132, which are show disposed on the rear major face of the electronic device 100 in this embodiment. In this illustrative embodiment, a user interface component 114, which may be a button or touch sensitive surface, can also be disposed along the rear-housing member 128.

In one embodiment, the electronic device 100 includes one or more connectors 112,113, which can include an analog connector, a digital connector, or combinations thereof. In this illustrative embodiment, connector 112 is an analog connector disposed on a first edge, i.e., the top edge, of the electronic device 100, while connector 113 is a digital connector disposed on a second edge opposite the first edge, which is the bottom edge in this embodiment.

A block diagram schematic 115 of the electronic device 100 is also shown in FIG. 1. In one embodiment, the electronic device 100 includes one or more processors 116. In one embodiment, the one or more processors 116 can include an application processor and, optionally, one or more auxiliary processors. One or both of the application processor or the auxiliary processor(s) can include one or more processors. One or both of the application processor or the auxiliary processor(s) can be a microprocessor, a group of processing components, one or more ASICs, programmable logic, or other type of processing device. The application processor and the auxiliary processor(s) can be operable with the various components of the electronic device 100. Each of the application processor and the auxiliary processor(s) can be configured to process and execute executable software code to perform the various functions of the electronic device 100. A storage device, such as memory 118, can optionally store the executable software code used by the one or more processors 116 during operation.

In this illustrative embodiment, the electronic device 100 also includes a communication circuit 125 that can be configured for wired or wireless communication with one or more other devices or networks. The networks can include a wide area network, a local area network, and/or personal area network. Examples of wide area networks include GSM, CDMA, W-CDMA, CDMA-2000, iDEN, TDMA, 2.5 Generation 3GPP GSM networks, 3rd Generation 3GPP WCDMA networks, 3GPP Long Term Evolution (LTE)

networks, and 3GPP2 CDMA communication networks, UMTS networks, E-UTRA networks, GPRS networks, iDEN networks, and other networks.

The communication circuit 125 may also utilize wireless technology for communication, such as, but are not limited to, peer-to-peer or ad hoc communications such as HomeRF, Bluetooth and IEEE 802.11 (a, b, g or n); and other forms of wireless communication such as infrared technology. The communication circuit 125 can include wireless communication circuitry, one of a receiver, a transmitter, or transceiver, and one or more antennas 126.

In one embodiment, the one or more processors 116 can be responsible for performing the primary functions of the electronic device 100. For example, in one embodiment the one or more processors 116 comprise one or more circuits operable with one or more user interface devices 111, which can include the display 102, to present presentation information to a user. The executable software code used by the one or more processors 116 can be configured as one or more modules 120 that are operable with the one or more processors 116. Such modules 120 can store instructions, control algorithms, and so forth.

In one embodiment, the one or more processors 116 are responsible for running the operating system environment 121. The operating system environment 121 can include a kernel 122 and one or more drivers, and an application service layer 123, and an application layer 124. The operating system environment 121 can be configured as executable code operating on one or more processors or control circuits of the electronic device 100.

The application layer 124 can be responsible for executing application service modules. The application service modules may support one or more applications or "apps." Examples of such applications shown in FIG. 1 include a cellular telephone application 103 for making voice telephone calls, a web browsing application 104 configured to allow the user to view webpages on the display 102 of the electronic device 100, an electronic mail application 105 configured to send and receive electronic mail, a photo application 106 configured to permit the user to view images or video on the display 102 of electronic device 100, and a camera application 107 configured to capture still (and optionally video) images. These applications are illustrative only, as others will be obvious to one of ordinary skill in the art having the benefit of this disclosure. The applications of the application layer 124 can be configured as clients of the application service layer 123 to communicate with services through application program interfaces (APIs), messages, events, or other inter-process communication interfaces. Where auxiliary processors are used, they can be used to execute input/output functions, actuate user feedback devices, and so forth.

In one embodiment, one or more proximity sensors 108 can be operable with the one or more processors 116. In one embodiment, the one or more proximity sensors 108 include one or more proximity sensor components 140. The proximity sensors 108 can optionally include one or more proximity detector components or other proximity sensor devices as well. In one embodiment, the proximity sensor components 140 comprise only signal receivers. By contrast, proximity detector components would include a signal receiver and a corresponding signal transmitter, and may be used as user interface devices when the user is handling the electronic device 100. While each proximity detector component can be any one of various types of In one or more embodiments the proximity sensor components have a longer detection range than do the proximity detector components due to the fact that the proximity sensor components detect heat emanating from a person's body while the proximity detector components rely upon reflections of infrared light emitted from the signal transmitter. For example, the proximity sensor component may be able to detect a person's body heat from a distance of about ten feet, while the signal receiver of the proximity detector component may only be able to detect reflected signals from the transmitter at a distance of about one to two feet. The ten-foot dimension can be extended as a function of designed optics, sensor active area, gain, lensing gain, and so forth. The two-foot dimension can be a function of power dissipation that increases significantly at larger distances due to the fact that only a small portion of the transmitted beam gets reflected.

In one embodiment, the proximity sensor component 140 comprises an infrared signal receiver so as to be able to detect infrared emissions from a person. Accordingly, the proximity sensor component 140 requires no transmitter since objects disposed external to the housing deliver emissions that are received by the infrared receiver. As no transmitter is required, each proximity sensor component 140 can operate at a very low power level. Simulations show that a group of infrared signal receivers can operate with a total current drain of just a few microamps. By contrast, a proximity detector component, which includes a signal transmitter, may draw hundreds of microamps to a few milliamps.

In one embodiment, the signal receiver of each proximity sensor component 140 can operate at various sensitivity levels so as to cause the at least one proximity sensor component 140 to be operable to receive the infrared emissions from different distances. For example, the one or more processors 116 can cause each proximity sensor component 140 to operate at a first "effective" sensitivity so as to receive infrared emissions from a first distance. Similarly, the one or more processors 116 can cause each proximity sensor component 140 to operate at a second sensitivity, which is less than the first sensitivity, so as to receive infrared emissions from a second distance, which is less than the first distance. The sensitivity change can be effected by causing the one or more processors 116 to interpret readings from the proximity sensor component 140 differently. For example, when the electronic device 100 is grabbed, only large readings from the proximity sensor component 140 might be used to control the electronic device 100. In other embodiments, the proximity sensor component 140 can be designed to have changing detection thresholds.

In one embodiment, the first sensitivity is selected to detect infrared emissions from a distance that is greater than five feet. In one embodiment, the second sensitivity is selected to detect infrared emissions from a distance that is less than one foot. In one embodiment, each sensitivity can be set by adjusting a gain associated with the at least one proximity sensor component 140. Alternatively, each sensitivity can be set by adjusting a detection threshold of the at least one proximity sensor component. For example, in one embodiment the one or more processors 116 transition the at least one proximity sensor component 140 from the first sensitivity to the second sensitivity by reducing a gain of the infrared signal receiver of the at least one proximity sensor component 140. In another embodiment, the one or more processors 116 can transition the at least one proximity sensor component 140 from the first sensitivity to the second sensitivity by increasing a detection threshold of the infrared signal receiver of the at least one proximity sensor component 140. Other methods of establishing each sensitivity, which defines from what distance infrared emissions can be detected, will be obvious to those of ordinary skill in the art having the benefit of this disclosure.

In one embodiment, the one or more processors 116 can adjust the sensitivity of the at least one proximity sensor component 140 between the first and second sensitivities. For example, in a default mode of operation the one or more processors 116 can operate the at least one proximity sensor component 140 at the first sensitivity until the infrared signal receiver of the at least one proximity sensor component 140 receives the infrared emissions from an object external to the housing 101. The one or more processors 116 can then operate the at least one proximity sensor component 140 at the second sensitivity after the infrared signal receiver of the at least one proximity sensor component 140 receives the infrared emissions from the object. However, in other embodiments, the one or more processors 116 operate the at least one proximity sensor component 140 at the second sensitivity only after a motion detector 141 detects motion of the electronic device 100. In one embodiment, the one or more processors 116 transition the at least one proximity sensor component 140 from the second sensitivity back to the first sensitivity when the infrared emissions are not received for a predetermined amount of time.

Figure 2:
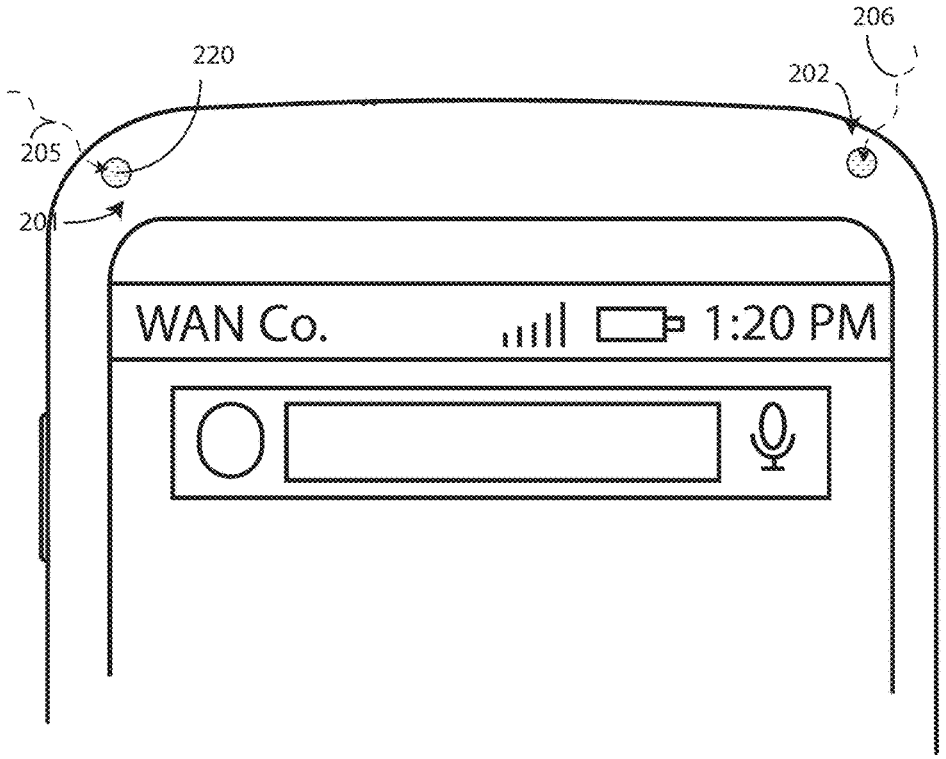
FIG. 2 illustrates explanatory proximity sensor component configurations in accordance with one or more embodiments of the disclosure.

Turning briefly to FIG. 2, illustrated therein are two proximity sensor components 201,202, each disposed at a corner of the electronic device 100. In this embodiment, each proximity sensor component 201,202 comprises a signal receiver 220, such as an infrared photodiode, to detect an infrared emission 205,206 from an object external to the housing 101 of the electronic device 100. No corresponding transmitter is included or required for the proximity sensor component 201,202 to function. As no active transmitter emitting signals is included, each proximity sensor component 201,202 is sometimes referred to as a "passive" proximity sensor.

Figure 3:
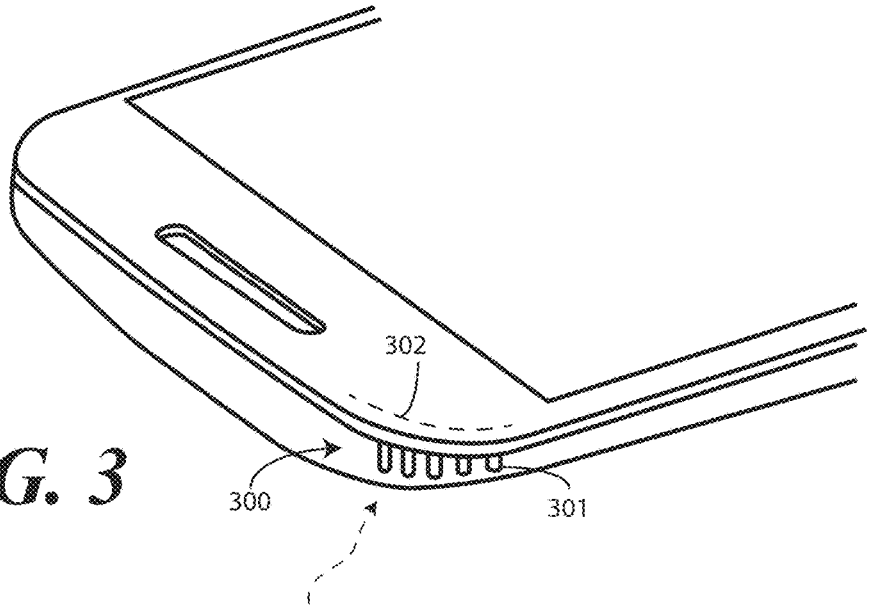
FIG. 3 illustrates one explanatory proximity sensor component configuration in accordance with one or more embodiment of the disclosure.

In one embodiment, the proximity sensor components 201,202 can include at least two sets of components. For example, a first set of components can be disposed at a first corner of the electronic device 100, while another set of components can be disposed at a second corner of the electronic device 100. As shown in FIG. 3, when the components are disposed at a corner 300 of the electronic device, the components can be disposed behind a grille 301 that defines one or more apertures through which infrared emissions are received.

In one embodiment, the grille 301 can define one or more reception beams in which infrared emissions can be received. The definition of such reception beams can enable the proximity sensor components (201,202) to detect motion by determining along which reception beams each emission is received. The proximity sensor components (201,202) can also detect changes across reception beams to detect motion as well.

The apertures of the grille 301 can be used to define various reception beams. In one embodiment, each grille 301 can be associated with a lens 302 disposed behind, outside, or integrally with the grille 301 to assist with the definition of the reception beams and/or serve as a water dust seal. For example, a polycarbonate lens 302 can be disposed behind the grille 301 and configured as a compound Fresnel lens with a predetermined number of slits, such as five or seven, to assist with the definition of the reception beams.

Figure 4:
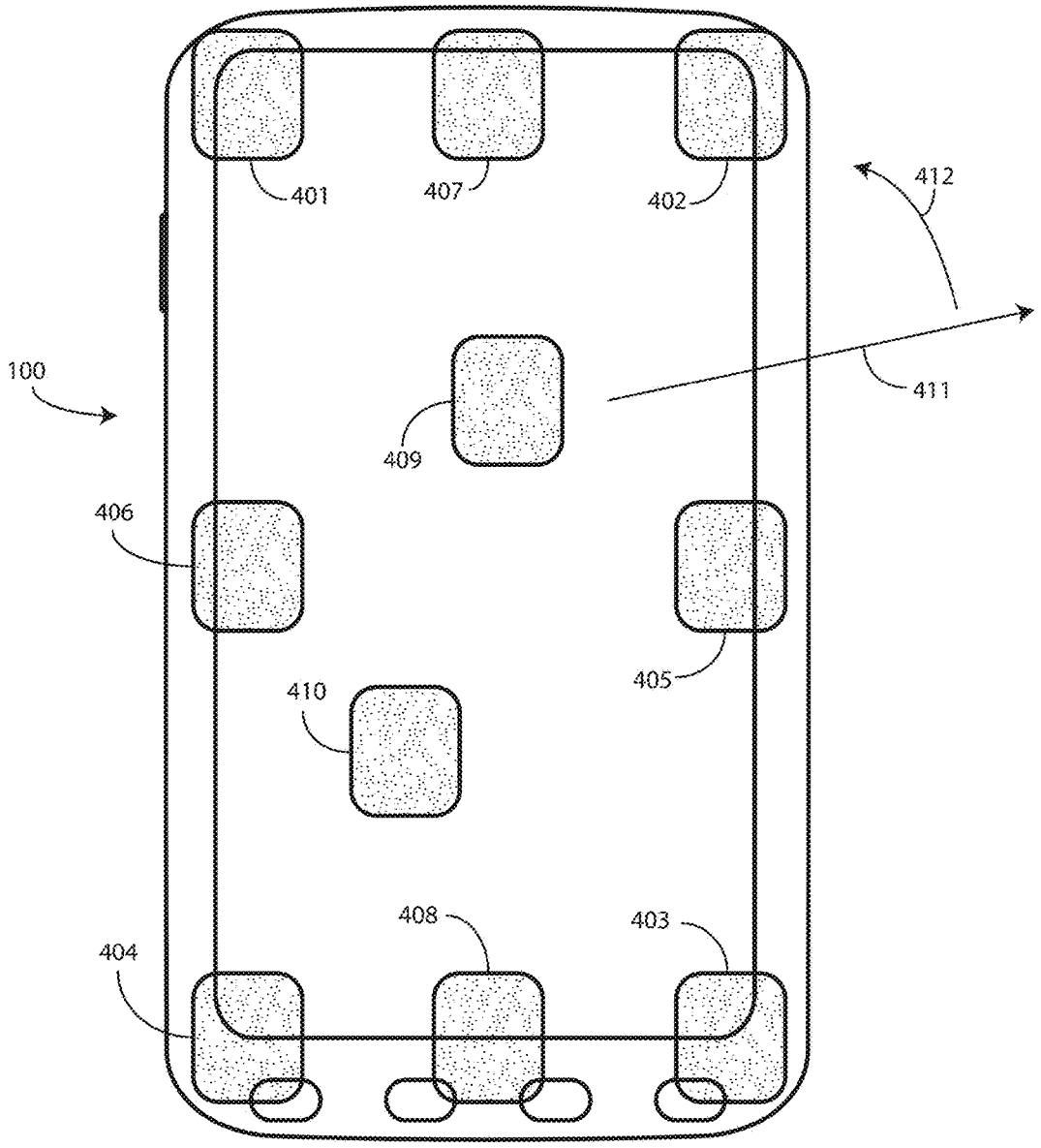
FIG. 4 illustrates explanatory locations along an electronic device where one or more proximity sensor components can be disposed in accordance with one or more embodiments of the disclosure.

It should be noted that corners 300 are not the only location at which proximity sensor components can be located. Turning now to FIG. 4, illustrated therein are some of the many locations at which proximity sensor components may be located. These locations include corner locations 401,402,403,404, edge locations 405,406, end locations 407,408, major face locations 409, or ad hoc locations 410 based upon location. These locations can be used individually or in combination to achieve the desired detection radius 411 and radial detection sweep 412 about the electronic device 100. For example, some components can be disposed along the front major face of the electronic device 100, while other components are disposed on the rear major face of the electronic device 100, and so forth. Other locations and combinations will be obvious to those of ordinary skill in the art having the benefit of this disclosure.

Turning now back to FIG. 1, in one embodiment, the one or more processors 116 may generate commands based on information received from one or more proximity sensors 108. The one or more processors 116 may generate commands based upon information received from a combination of the one or more proximity sensors 108 and one or more other sensors 109. The one or more processors 116 may process the received information alone or in combination with other data, such as the information stored in the memory 118.

The one or more other sensors 109 may include a microphone, and a mechanical input component such as button or key selection sensors, touch pad sensor, touch screen sensor, capacitive sensor, and switch. Touch sensors may used to indicate whether the device is being touched at side edges, thus indicating whether or not certain orientations or movements are intentional by the user. The other sensors 109 can also include surface/housing capacitive sensors, audio sensors, and video sensors (such as a camera).

The other sensors 109 can also include motion detectors 141, such as an accelerometer 142 or a gyroscope. For example, an accelerometer 142 may be embedded in the electronic circuitry of the electronic device 100 to show vertical orientation, constant tilt and/or whether the device is stationary.

Other components 110 operable with the one or more processors 116 can include output components such as video, audio, and/or mechanical outputs. For example, the output components may include a video output component such as the display 102 or auxiliary devices including a cathode ray tube, liquid crystal display, plasma display, incandescent light, fluorescent light, front or rear projection display, and light emitting diode indicator. Other examples of output components include audio output components such as speaker port 132 or other alarms and/or buzzers and/or a mechanical output component such as vibrating or motion-based mechanisms.

It is to be understood that FIG. 1 is provided for illustrative purposes only and for illustrating components of one electronic device 100 in accordance with embodiments of the disclosure, and is not intended to be a complete schematic diagram of the various components required for an electronic device. Therefore, other electronic devices in accordance with embodiments of the disclosure may include various other components not shown in FIG. 1, or may include a combination of two or more components or a division of a particular component into two or more separate components, and still be within the scope of the present disclosure.

In one or more embodiments, the electronic device 100 can be operated in multiple modes of operation. A first mode, referred to herein as the "default" mode of operation, occurs where the electronic device 100 is not actively being used by a user. Instead, when in the default mode of operation, in one embodiment the one or more processors 116 can be placed in a low power or sleep mode while the one or more proximity sensor components 140 are active. In another embodiment, the one or more processors 116 cause at least the user interface 111 and/or display 102 to enter a low power or sleep mode when the infrared signal receiver of the one or more proximity sensor components 140 are not receiving the infrared emissions from external sources.

Once the one or more proximity sensor components 140 receive an infrared emission from an object external to the housing 101 of the electronic device 100, the one or more processors 116 of the electronic device 100 can transition to an "active" mode of operation and are operable to actuate one or more user interface devices. For example, when initially entering the active mode of operation, the one or more processors 116 may activate the motion detector 141. Once the motion detector 141 detects motion of the electronic device 100, the one or more processors 116 can actively operating user interface devices such as the display 102, audio outputs, microphones, and so forth.

Thus, illustrating by example, when a user is not using the electronic device 100, the device—or at a minimum the user interface—may be in a sleep or low power mode in the default mode of operation. The one or more proximity sensor components 140 then operate at a first sensitivity to actively monitor for the receipt of infrared emissions from a first distance, which indicates that a user is within a first reception radius of the one or more proximity sensor components 140. When infrared emissions are received from a source external to the housing 101 of the electronic device 100, the one or more processors 116 can detect this and can actuate the motion detector 141 in anticipation of the user's next action, which would be the user lifting the electronic device. Said differently, the one or more processors 116 can activate the motion detector 141 when the at least one proximity sensor component 140 operates at the first sensitivity and the infrared signal receiver receives the infrared emissions.

In one embodiment, the one or more processors 116 can cause the at least one proximity sensor component 140 to operate at a second sensitivity after the infrared signal receiver of the at least one proximity sensor component 140 receives the infrared emissions from the object to cause the at least one proximity sensor component 140 to receive infrared emissions from a second reception radius that is shorter than the first. This transition can occur concurrently with the one or more processors 116 actuating the motion detector 141. Alternatively, this transition can occur only after the motion detector 141 detects motion of the electronic device 100 in other embodiments. Accordingly, the user arrives at a device ready for activation upon the user picking up the device, rather than the user having to manipulate buttons and controls to wake the device from the default mode, and wait for all systems to boot.

Figure 5:
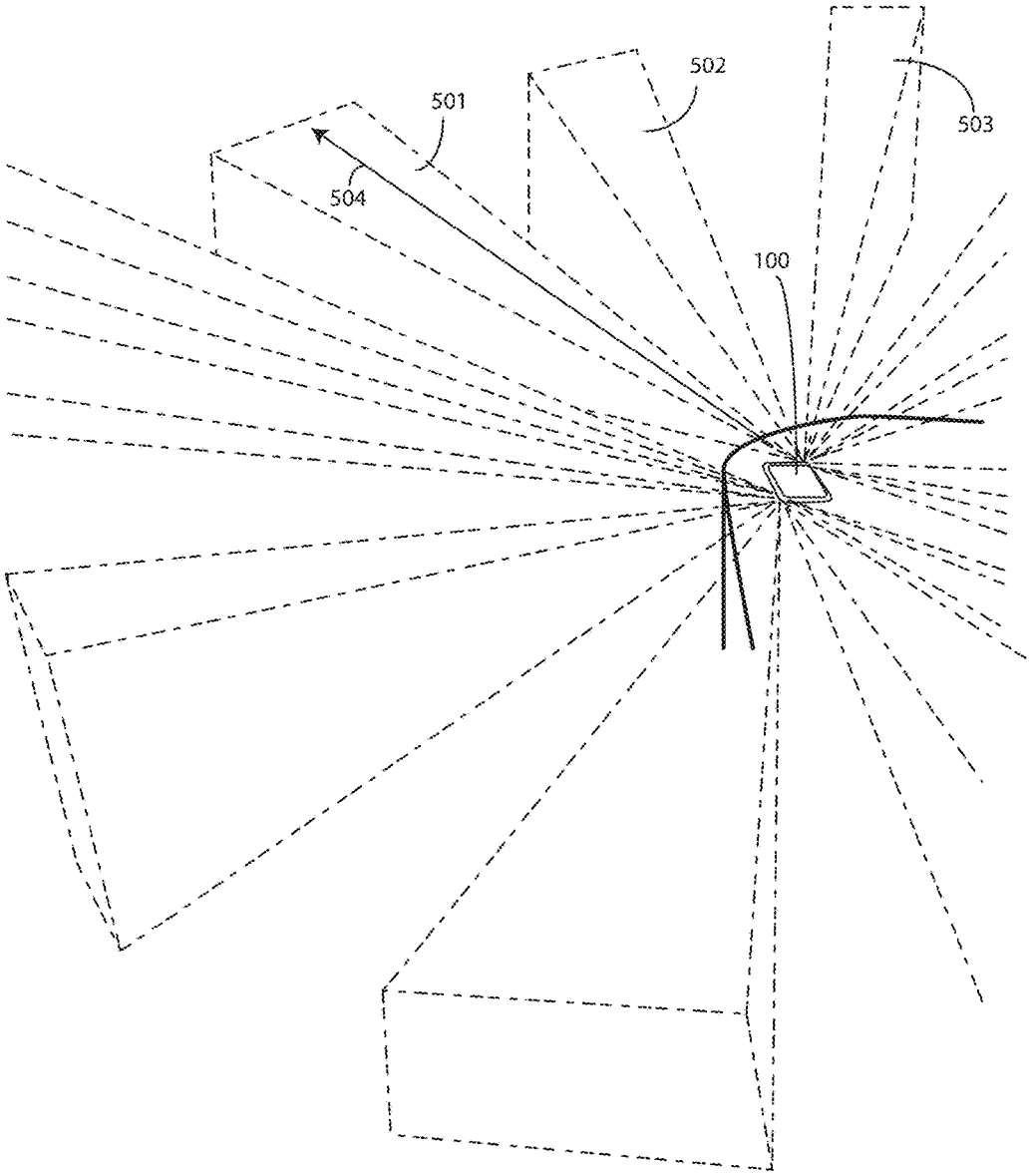
FIG. 5 illustrates an explanatory device having one or more proximity sensor components comprising infrared signal receivers in accordance with one or more embodiments of the disclosure.
Figure 6:
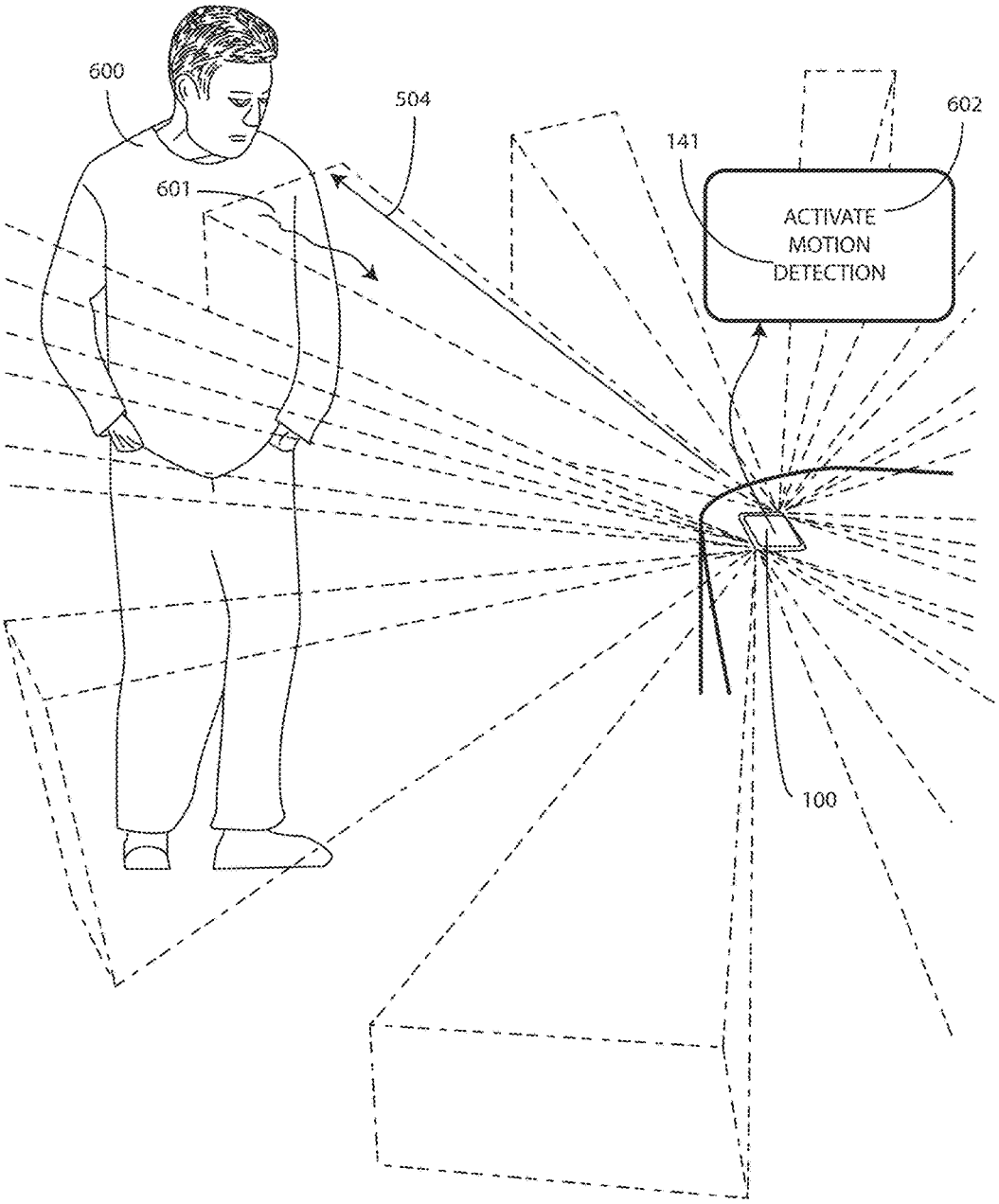
FIG. 6 illustrates the explanatory device of FIG. 5 receiving an infrared emission from an object external to the housing and executing one or more method steps, each in accordance with one or more embodiments of the disclosure.
Figure 7:
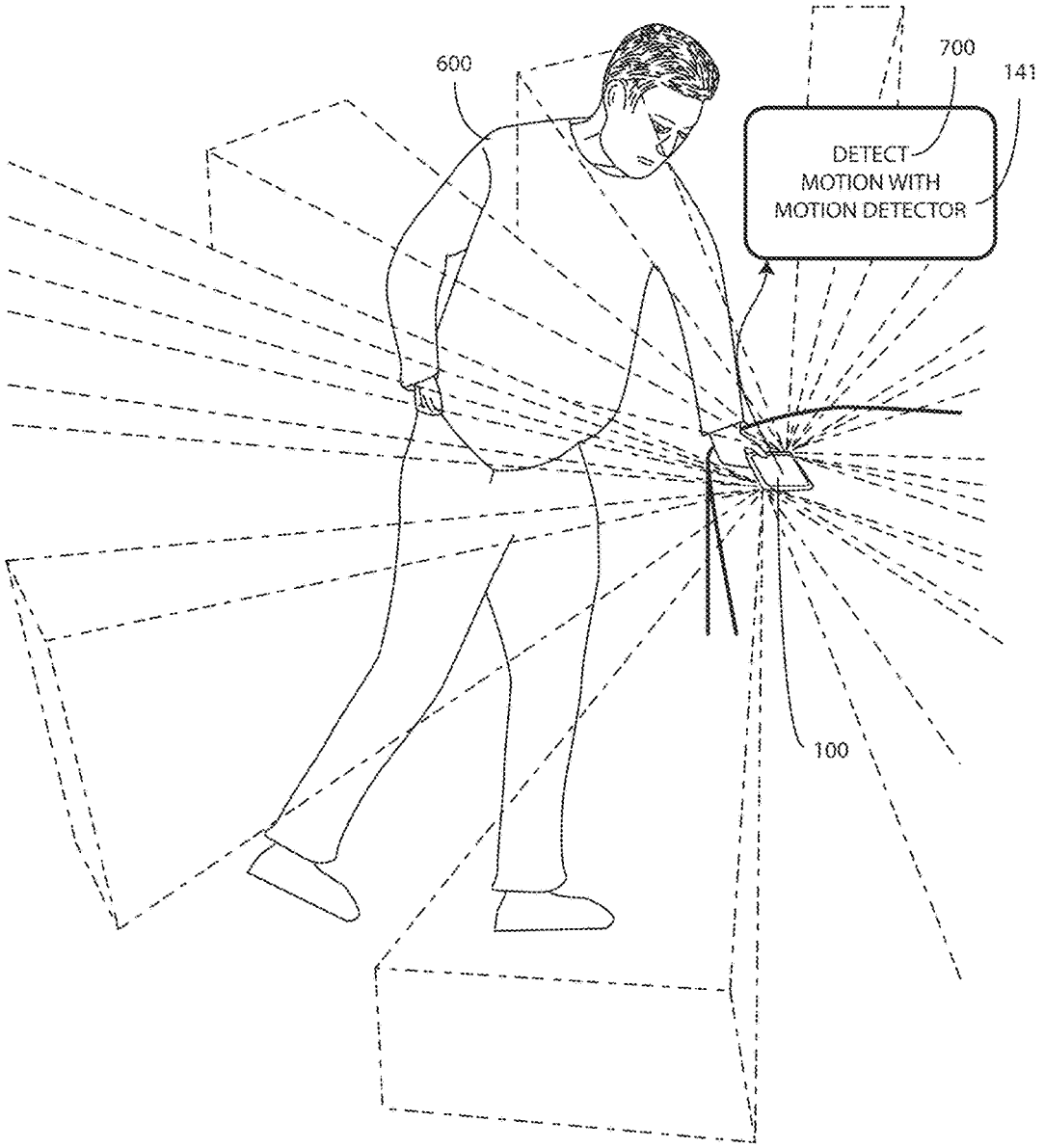
FIG. 7 illustrates the explanatory device of FIG. 6 executing one or more additional method steps in accordance with one or more embodiments of the disclosure.
Figure 8:
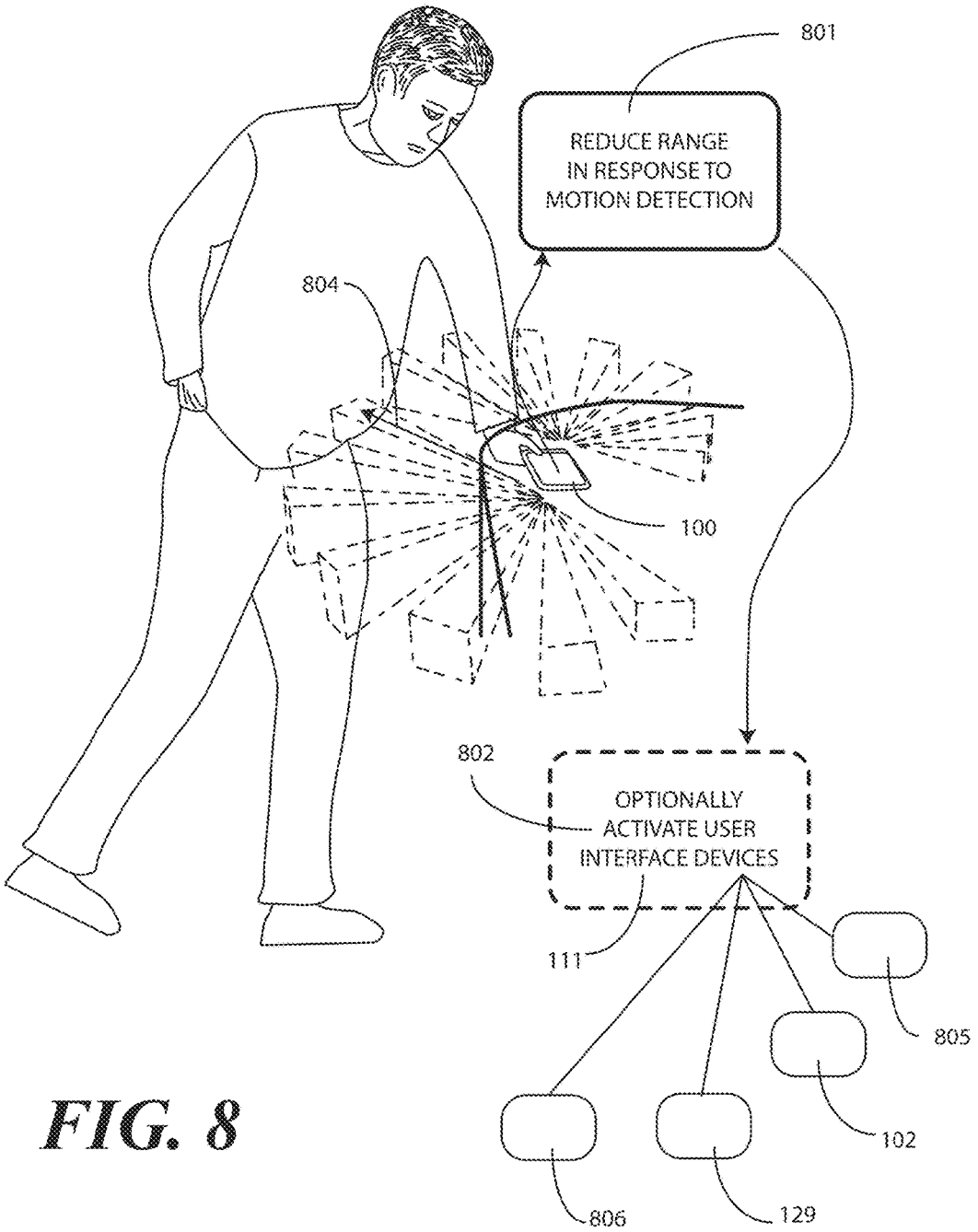
FIG. 8 illustrates the explanatory device of FIG. 7 executing one or more additional method steps in accordance with one or more embodiments of the disclosure.

This process is shown generally in FIGS. 5-7, with additional features shown in FIG. 8. Beginning with FIG. 5, the electronic device 100 is in the default mode of operation. Most components, including the display (102), motion detector (141), other sensors (109), and components (110) are in a low power or sleep mode. However, the one or more proximity sensor components (140) are in their active mode and are operating at a first sensitivity to receive infrared emissions from a first distance indicated by reception radius 504. The one or more proximity sensor components (140) are actively waiting to receive infrared emissions from an object external to the housing (101) of the electronic device 100. As shown in FIG. 5, one or more signal reception beams 501,502,503 can be defined within which infrared emissions are received as previously described above with reference to FIG. 3. In this embodiment, the signal reception beams 501,502,503 define a 360-degree reception area or heat sensor coverage zone about the device with a reception radius 504 of about ten feet when the one or more proximity sensor components (140) are operating at the first sensitivity. As no user is within this reception radius 504, power consumption within the electronic device 100 can remain extremely low.

Turning now to FIG. 6, a user 600 enters the reception radius 504. The user's body heat results in an infrared emission 601 being delivered to the one or more proximity sensor components (140) of the electronic device 100. When this occurs, in one embodiment the one or more processors (116) are operable to actuate 602 the motion detector 141. Accordingly, the motion detector 141 can be activated in response to the one or more proximity sensor components (140) receiving the infrared emission 601 while operating at the first sensitivity to detect motion of the electronic device 100 when the user 600 picks it up. Following pick-up, thermal range interpretation can be altered to only allow the electronic device 100 to change operation based on strong levels thermal detections only.

Turning to FIG. 7, the user 600 is lifting the electronic device 100. The motion detector 141 detects 701 this motion and alerts one or more processors (116) of the electronic device 100. Turning to FIG. 8, the one or more processors (116) of the electronic device 100 transition 801 the sensitivity of the one or more proximity sensor components (140) from the first sensitivity to the second sensitivity. In one embodiment, this transition occurs in response to the motion detector (141) detecting motion. However, in another embodiment, this transition could occur after receiving the first infrared emission 601 as shown above in FIG. 6. Regardless of cause, in one embodiment the transition causes the at least one proximity sensor component (140) to receive infrared emissions from a second distance indicated by reception radius 804. As seen by comparing FIG. 6 and FIG. 7, in this example the second distance is less than the first distance.

The one or more processors (116) may additionally activate 802 one or more user interface devices 111 in response to the motion detector (141) detecting motion as well. For example, in one embodiment the user interface devices comprise a microphone 805. In another embodiment, the user interface devices comprise a display 102. In another embodiment, the user interface devices comprise a camera 129. In another embodiment, the user interface devices comprise a proximity detector component 806 that includes a signal emitter and a corresponding signal receiver. Other user interface devices suitable for activation in response to the motion detector (141) detecting motion will be obvious to those of ordinary skill in the art having the benefit of this disclosure. In one embodiment, the goal of actuating these additional user interface devices is so that the electronic device 100 will be actively awaiting a user's next action and will not have to be manually pulled from the default mode of operation into the active mode of operation.

Figure 9:
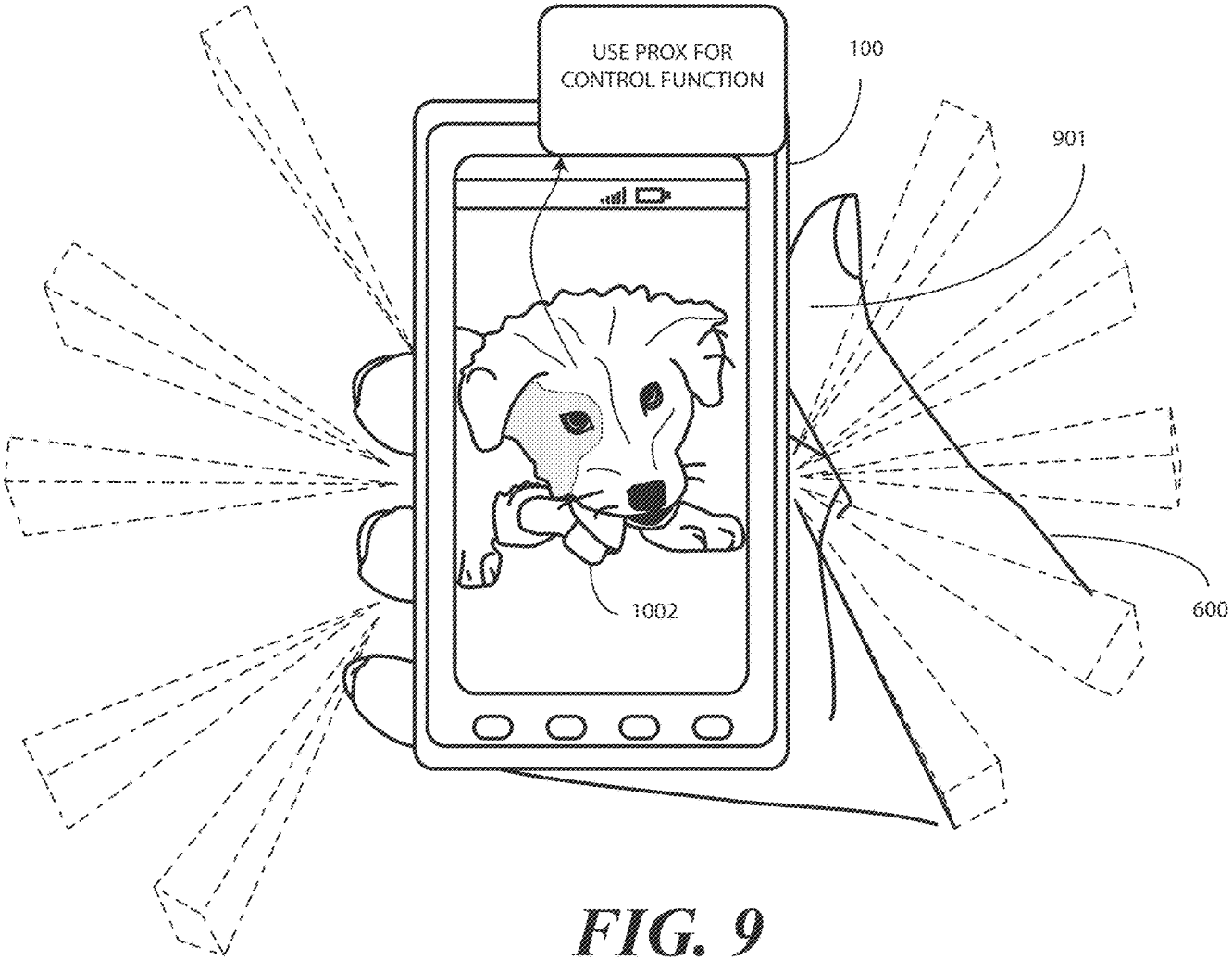
FIG. 9 illustrates a user delivering user input to an electronic device to control the electronic device in accordance with one or more embodiments of the disclosure.

In one embodiment, when in the active mode as shown in FIG. 9, infrared emissions received from the hand of the user 600 by the one or more proximity sensor components 140 can be interpreted as user input. For example, the user 600 may slide his thumb 901 along the side of the electronic device 100, thereby causing infrared emissions of differing intensities to be received at the one or more proximity sensor components (140). The one or more processors (116) of the electronic device 100 can interpret this as user input to, for example, scroll pictures 1002 along the display. Other examples of functions the user 600 can control by delivering varying infrared emissions to the proximity sensor components (140) include control of the volume of an audio output, control of the magnification of the image, control of the zoom level, and so forth. These are examples only, as other functions will be obvious to those of ordinary skill in the art having the benefit of this disclosure.

As shown above with reference to FIGS. 5-9, an electronic device 100 includes a housing (101), one or more processors (116), and at least one proximity sensor component (140) operable with the one or more processors and comprising an infrared signal receiver to receive infrared emissions (601) from objects external to the housing (101). A motion detector (141) is operable with the one or more processors (116). The one or more processors (116) are operable to cause the at least one proximity sensor component (140) to be operable to receive the infrared emissions from a first distance. The one or more processors (116) can, upon the infrared signal receiver receiving the infrared emissions (601) from an object external to the housing (101), actuate the motion detector (141). Further, upon the motion detector (141) detecting movement of the housing (101), the one or more processors (116) can cause the at least one proximity sensor component (140) to receive the infrared emissions (601) from a second distance.

Upon the motion detector (141) detecting movement of the housing (101), the one or more processors (116) can optionally actuate other components, including a microphone (805), display (102), or other devices. If the one or more proximity sensor components (140) fail to detect the infrared emissions (601) for a predetermined amount of time, which indicates that no user is using the electronic device 100, the one or more processors (116) can optionally cause the display (102) or other user interface components to enter a low power or sleep mode. In one embodiment, the one or more proximity sensor components (140) are active when the other components of the electronic device 100 are in the low power or sleep mode.

Figure 10:
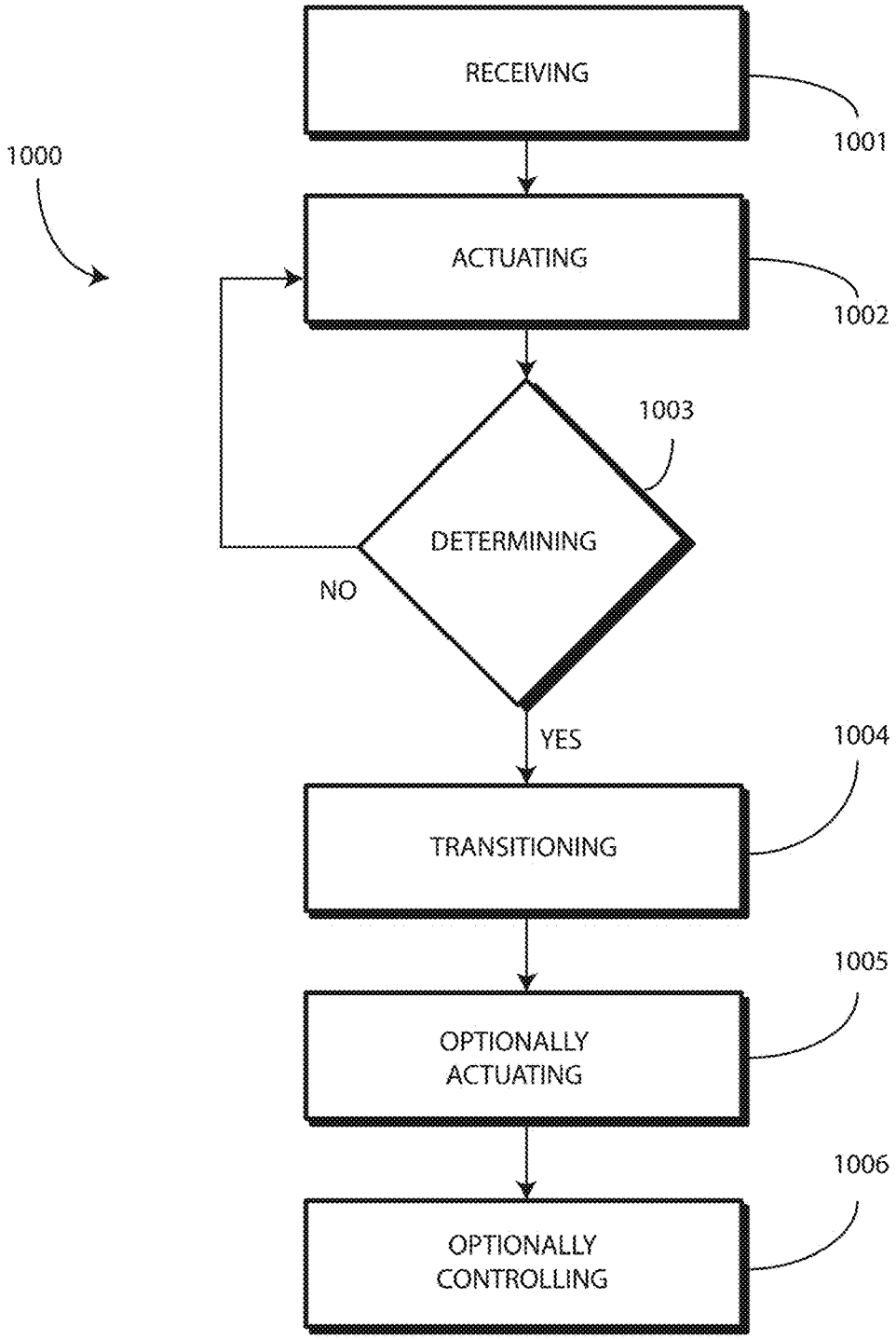
FIG. 10 illustrates one explanatory method in accordance with one or more embodiments of the disclosure.

Turning now to FIG. 10, illustrated therein is one explanatory method 1000 suitable for use with an electronic device in accordance with one or more embodiments of the disclosure. At step 1001, the method 1000 receives, with at least one proximity sensor component comprising an infrared signal receiver operating at a first sensitivity, infrared emissions from objects external to a housing of the electronic device. At step 1002, the method actuates a motion detector. In one embodiment, step 1002 occurs in response to step 1001 occurring. Whether motion is detected by the motion detector is determined at decision 1003.

At step 1004, the method 1000 transitions the infrared signal receiver to a second sensitivity. In one embodiment, the second sensitivity causes infrared emissions to be detected from a second distance that is shorter than the first distance associated with the first sensitivity. In one embodiment, step 1004 occurs in response to detecting motion with the motion detector at decision 1003. In another embodiment, step 1004 occurs in response to step 1001 occurring.

At optional step 1005, the method 1000 can include actuating one of a display or a microphone. In one embodiment, this step 1005 occurs in response to detecting motion with the motion detector at decision 1003.

At optional step 1006, the method 1000 further includes controlling the electronic device with the infrared emissions when the infrared signal receiver is operating at the second sensitivity. At optional step 1007, the method 1000 includes transitioning the at least one proximity sensor component from the second sensitivity to the first sensitivity in absence of the infrared emissions for a predetermined time. The predetermined time can be obtained by starting a timer after any of steps 1004 or 1005, or alternatively after decision 1003.

In the foregoing specification, specific embodiments of the present disclosure have been described. However, one of ordinary skill in the art appreciates that various modifications and changes can be made without departing from the scope of the present disclosure as set forth in the claims below. Thus, while preferred embodiments of the disclosure have been illustrated and described, it is clear that the disclosure is not so limited. Numerous modifications, changes, variations, substitutions, and equivalents will occur to those skilled in the art without departing from the spirit and scope of the present disclosure as defined by the following claims. Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims. The disclosure is defined solely by the appended claims including any amendments made during the pendency of this application and all equivalents of those claims as issued.

What is claimed is:

1. An electronic device, comprising:

a housing;

one or more processors;

at least one proximity sensor component operable with the one or more processors and comprising an infrared signal receiver to receive an infrared emission from an object external to the housing;

a motion detector operable with the one or more processors;

the one or more processors operable to:

operate the at least one proximity sensor component at a first sensitivity until the infrared signal receiver receives the infrared emission from the object;

activate the motion detector when the at least one proximity sensor component operates at the first sensitivity and the infrared signal receiver receives the infrared emission;

transition the at least one proximity sensor component from the first sensitivity to a second sensitivity in response to the infrared signal receiver receiving the infrared emission from the object, the one or more processors to transition the at least one proximity sensor component from the first sensitivity to the second sensitivity by increasing a detection threshold of the infrared signal receiver; and operate the at least one proximity sensor component at the second sensitivity after the infrared signal receiver receives the infrared emission from the object and only after the motion detector detects motion of the electronic device;

the second sensitivity less than the first sensitivity.

2. The electronic device of claim 1, the motion detector comprising an accelerometer.

3. The electronic device of claim 1, the one or more processors to transition the at least one proximity sensor component from the second sensitivity to the first sensitivity when the infrared emission is not received for a predetermined amount of time.

4. The electronic device of claim 1, the first sensitivity to detect the infrared emission from greater than five feet.

5. The electronic device of claim 1, the second sensitivity to detect the infrared emission from less than one foot.

6. An electronic device, comprising:

a housing;

one or more processors;

at least one proximity sensor component operable with the one or more processors and comprising an infrared signal receiver to receive an infrared emission from an object external to the housing; and a motion detector operable with the one or more processors;

the one or more processors operable to:

cause the at least one proximity sensor component to be operable to receive the infrared emission from a first distance;

upon the infrared signal receiver receiving the infrared emission from the object, actuate the motion detector; and upon the motion detector detecting movement of the housing, cause the at least one proximity sensor component to receive the infrared emission from a second distance;

the second distance less than the first distance.

7. The electronic device of claim 6, further comprising a microphone operable with the one or more processors, the one or more processors to, upon the motion detector detecting the movement of the housing, actuate the microphone.

8. The electronic device of claim 6, further comprising a display operable with the one or more processors, the one or more processors to, upon the motion detector detecting the movement of the housing, actuate the display.

9. The electronic device of claim 8, the one or more processors to cause the display to enter a low power or sleep mode when the infrared signal receiver is not receiving the infrared emission.

10. The electronic device of claim 8, the one or more processors to operate the at least one proximity sensor component while the display is in a low-power or sleep mode.

11. The electronic device of claim 6, the one or more processors to receive user input to control one or more functions of the electronic device from the infrared emission received from the second distance.

12. The electronic device of claim 6, the motion detector comprising an accelerometer.

13. A method in an electronic device, the method comprising:

receiving, with at least one proximity sensor component comprising an infrared signal receiver operating at a first sensitivity, an infrared emission from an object external to a housing;

actuating a motion detector; and in response to detecting motion with the motion detector, transitioning the infrared signal receiver to a second sensitivity.

14. The method of claim 13, further comprising controlling the electronic device with the infrared emission when the infrared signal receiver is operating at the second sensitivity.

15. The method of claim 13, further comprising, in response to detecting motion with the motion detector, actuating one or more of a display or a microphone.

16. The method of claim 13, further comprising transitioning the at least one proximity sensor component from the second sensitivity to the first sensitivity in absence of the infrared emission.

* * * * *